United States Patent [19]

Lin

[11] Patent Number: 4,925,105

[45] Date of Patent: May 15, 1990

[54] RECHARGEABLE GARDEN SPRAYER

[76] Inventor: Hsien C. Lin, No. 3, Lane 201, Kai Nan Street, Tainan City, Taiwan

[21] Appl. No.: 337,850

[22] Filed: Apr. 14, 1989

[51] Int. Cl.[5] ..... B05B 9/08

[52] U.S. Cl. ..... 239/154; 239/332; 239/333; 222/175; 222/333

[58] Field of Search ..... 239/332, 333, 337, 281, 239/152, 153, 154; 222/333, 175, 530, 538

[56] References Cited

U.S. PATENT DOCUMENTS

| | | | |
|---|---|---|---|
| 3,901,449 | 8/1975 | Bochmann | 239/333 |
| 3,904,116 | 9/1975 | Jones et al. | 239/332 |
| 4,519,544 | 5/1985 | Szabo | 239/281 |
| 4,618,099 | 10/1986 | Nagao et al. | 239/332 |
| 4,621,770 | 11/1986 | Sayen | 239/332 |
| 4,801,088 | 1/1989 | Baker | 239/332 |

*Primary Examiner*—Andres Kashnikow
*Assistant Examiner*—Christopher G. Trainor
*Attorney, Agent, or Firm*—Thomas S. Keaty

[57] ABSTRACT

A rechargeable garden sprayer includes a container having an opening on an upper face, a lower suction tube, and an inlet formed at a side thereof. The inlet cooperates internally with the main body of the container such that liquid poured in through the inlet flows to the container. An engaging body has a base with about the same shape and size as the upper face of the container so as to be mounted on the container. The engaging body includes a number of upstanding hollow tubes along its periphery and a fixing panel to define a retaining recess. A top cover having substantially an inverted U-shaped body has two side panels with a number of downwardly extending poles at an inner side thereof for inserting into the hollow tubes and thus engaging with the engaging body. The top cover has a handle on its uppermost part. The garden sprayer further comprises, a power unit including a closed-type battery, a socket, a pump, and a switch, and a nozzle tube which is telescopic and includes an engaging ring, a gripping tube, a soft hose, a middle tube, an upper tube, and a nozzle head.

12 Claims, 4 Drawing Sheets

RECHARGEABLE GARDEN SPRAYER

BACKGROUND OF THE INVENTION

The present invention relates generally to garden sprayers, and more particularly, to a rechargeable garden sprayer which is operable in an easy and convenient manner.

Heretofore, manually operated garden sprayers and garden sprayers powered by dry batteries have been employed in spraying garden plants. Garden sprayers powered by dry batteries are uneconomical due to the short life span of the dry batteries. Manually operated garden sprayer which requires the user to continually pump his arms in order to provide suction to draw the liquid in the tank into the nozzle tube for spraying work is considered very inconvenient. The situation is even worse if the plant to be sprayed is too tall and the user might have to stand at a higher position.

SUMMARY OF THE INVENTION

It is therefore a primary object of the present invention to provide a garden sprayer which mitigates and/or obviates the afore-mentioned drawbacks.

Another object of the present invention is to provide a garden sprayer having a structure which can be powered by rechargeable batteries.

A further object of the present invention is to provide a garden sprayer having a telescopic nozzle tube which facilitates the spraying work, especially the spraying of taller plants.

Still another object of the present invention is to provide a garden sprayer having a structure which includes a belt for easier carrying.

Further objects and advantages of the present invention will be apparent upon reading the detailed description provided hereinbelow, with appropriate reference to the accompanied drawings.

DETAILED DESCRIPTION OF THE PREFERRED EMBODIMENT

Figure 1:
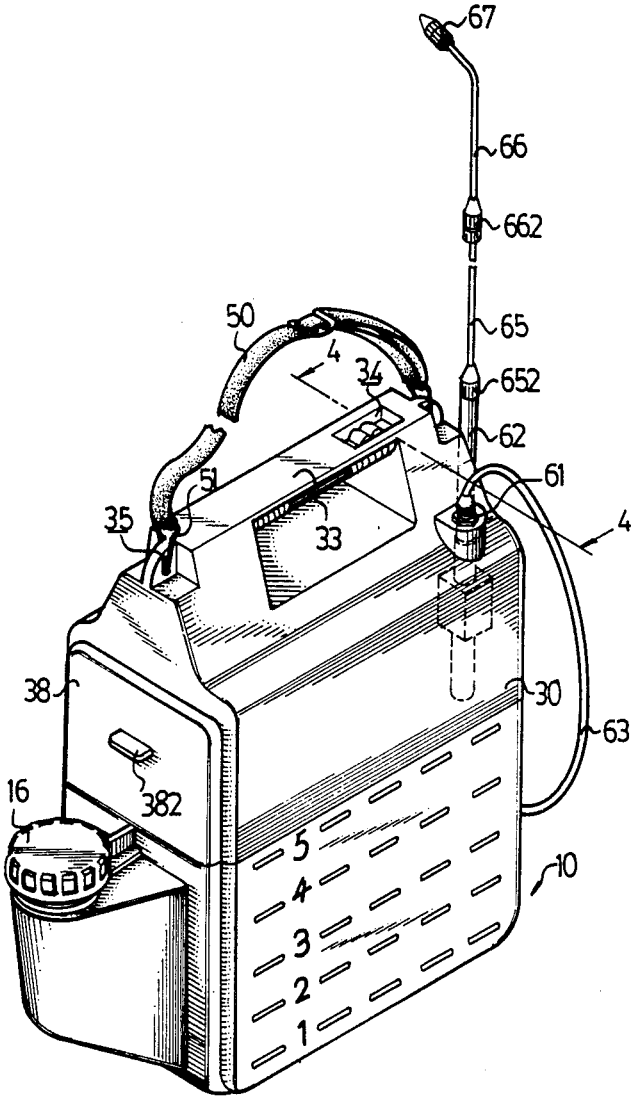
FIG. 1 is perspective view of a garden sprayer in accordance with the present invention.
Figure 2:
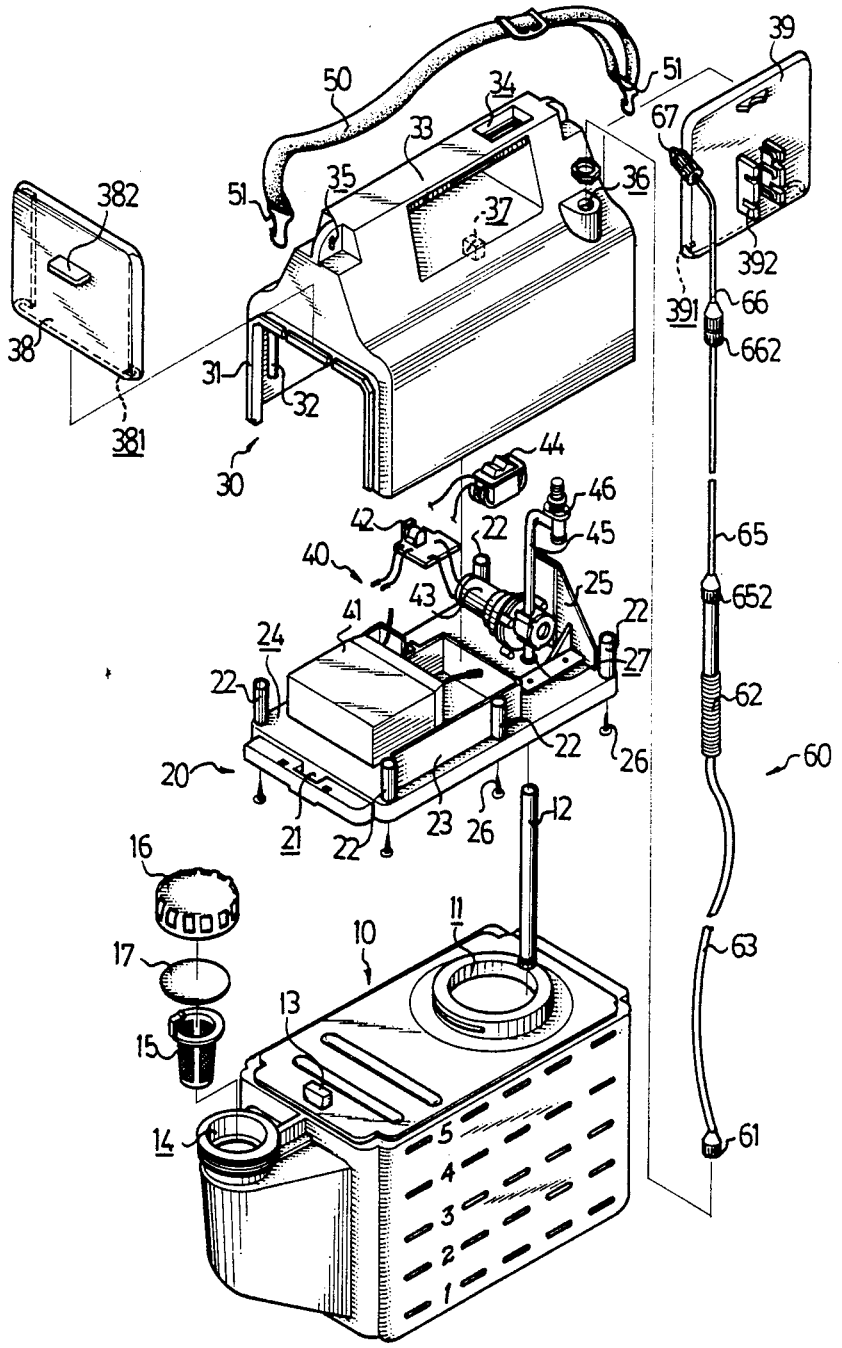
FIG. 2 is an exploded view of the garden sprayer shown in FIG. 1.

Referring to the drawings and initially to FIGS. 1 and 2, it can be seen that a garden sprayer in accordance with the present invention comprises a container 10, an engaging body 20, a top cover 30, a power unit 40, a belt 50, and a nozzle tube 60.

The container 10, which is injection-molded by any suitable plastic material, includes an opening 11 on the upper face thereof. A lower suction tube 12 is insertable in the container 10 through the opening 11. On an edge of the upper face, the container 10 is provided with a knob 13. An inlet 14 is formed at a lateral side of the container 10. The inlet 14 cooperates internally with the main body of the container 10 such that liquid poured in through the inlet 14 flows to the container 10 inherently. Although not limited thereto, it is often preferable that the inlet 14 be provided with a filter net 15. A cap 16, preferably having a sealing pad 17, is provided to close the inlet 14. Two lateral surfaces of the container 10 are, preferably, respectively provided with indicating means to indicate the liquid level in the container 10.

The engaging body 20 has a base having a shape and size substantially the same as the upper face of the container 10 so as to be mounted matchingly on the container 10. The engaging body 20 includes a slot 21 for receiving the knob 13 of the container 10. The engaging body 20 further includes a plurality of upstanding hollow tubes 22 along the periphery of the base. A fixing panel 23 is provided to define a retaining recess 24. On the side remote from the slot 21, a border panel 25 is formed on the base in an upstanding manner. A plurality of screws 26 equal to the number of the hollow tubes 22 are provided to combine the engaging body 20 with the top cover 30, which will be explained in detail hereinafter. The base of the engaging body 20 is provided with a hole 27 for the lower suction tube 12 to pass through.

The top cover 30 is substantially an inverted U-shaped body having two fixing edges 31. The top cover includes two side panels. The inner sides of the two side panel of the top cover 30 are provided with a plurality of downwardly extending poles 32. The upstanding hollow tubes 22 of the engaging body 20 receive and retain the downwardly extending poles 32 therein so as to secure the top cover 30 to the engaging body 20. It should be noted that the number of the poles 32 is equal to the number of the hollow tubes 22 and the diameter of each pole 32 is equal to the inner diameter of each hollow tube 22. Also, each hollow tube 22 is provided with threading internally (not shown) for better engaging effect. On the uppermost part of the top cover 30, there is provided a handle 33. A small recess 34 is formed on the handle 33 for retaining a switch, which will be explained more fully below. Both of the ends of the handle 33 are provided with a hole 35 for receiving the hooks 51 of the belt 50. The top cover 30 is further provided with a fixing hole 36 at the upper face thereof with respect to one side of the handle 33. A charging hole 37 is formed on the upper face beneath the handle 33. A first end cover 38 and a second end cover 39, having substantially the same structures, are slideably engageable with the main body of the top cover 30. The end covers 38 and 39 both include fixing grooves 381 and 391 respectively for engagement with the fixing edges 31. The first end cover 38 further includes a plate 382 while the second end cover 39 further includes a holder 392 for holding the nozzle tube 60.

The power unit 40 comprises a closed-type battery 41, a socket 42, a pump 43, a switch 44, and an upper suction tube 45 formed on an upper part of the pump 43. The closed-type battery 41 is retained in the retaining recess 24 of the engaging body 20. The socket 42 is retained within the engaging body 20 in alignment with the charging hole 37 of the top cover 30. The pump 43 is fixed to the side of the border panel 25. The switch 44 is retained in the small recess 34 of the top cover 30. The upper suction tube 45 is provided with a screw rod 46 on an uppermost part thereof. When the top cover 30 and the engaging body 20 are engaged through the use of hollow tubes 22, poles 32 and screws 26, the screw rod 46 passes through the fixing hole 36 of the top cover 30 and can be fixed by a nut.

An upper portion of the lower suction tube 12 of the container 10 passes through the hole 27 of the base of the engaging body 20 and is fixed to a bottom part of the pump 43 so as to communicate with the upper suction tube 45. The knob 13 of the container 10 matches with the slot 21 of the engaging body 20 and the container 10 is accordingly combined with the engaging body 20 to form the main body of the sprayer of the present invention.

Figure 3:
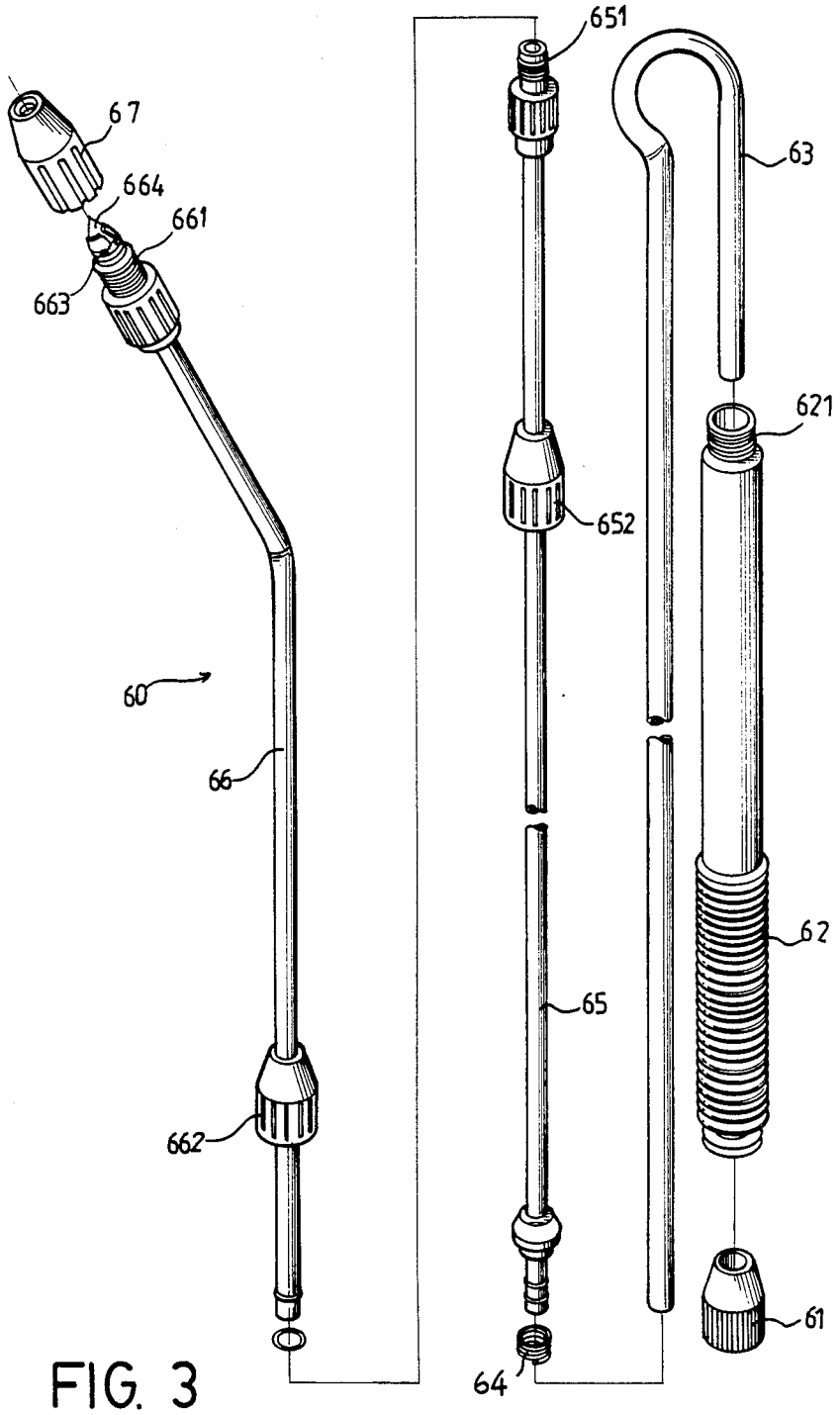
FIG. 3 is an exploded view of a nozzle tube of the garden sprayer constructed in accordance with the present invention.

Referring next to FIGS. 2 and 3, it can be seen that the nozzle tube 60 is telescopic and includes an engaging ring 61, a gripping tube 62, a soft hose 63, a coil 64, optionally one or more middle tubes 65, an upper extension tube 66, and a nozzle head 67.

The engaging ring 61 is provided with threading on the lower part. The gripping tube 62 is hollow with one end part thereof provided with threading 621. The soft hose 63 can pass through the interior part of the gripping tube 62. An end of the soft hose 63 is fixed on the engaging ring 61 at the part having threading, while another end part is fixed on the middle tube 65 by the coil 64. The middle tube 65 is hollow with one end part provided with threading 651. A slidable engaging round band 652 encompasses the middle tube 65 and combines with the threading 621 of the gripping tube 62 such that the gripping tube 62 and the middle tube 65 are combinable. The upper extension tube 66 is hollow and has a slanted end part. An end part of the upper extension tube 66 is provided with threading 661. The upper extension tube 66 also includes a slidable engaging round band 662 which encompasses the upper extension tube 66 and matches the threading 651 of the middle tube 65 such that the upper extension tube 66 and the middle tube 65 can be combined together. The tip of the upper extension tube 66 is in cone-shaped form. On the tip of the upper extension tube 66, two outlets 663 are formed. The tip of the upper extension tube 66 is further provided with a spiral groove 664 such that the nozzle head 67 can be fixed thereon. The nozzle head 67, of course, has an opening for liquid to spray out.

After the assembly of the nozzle tube 60, the engaging ring 61 can be fixed on the screw rod 46 of the upper suction tube 45 of the top cover 30 such that the lower suction tube 16, the upper suction tube 45 and the nozzle tube 60 are in communication with each other. The gripping tube 62 can be fixed on the holder 392 of the second end cover 39 of the top cover 30. Also, the belt 50 of adjustable length can be hooked to the top cover 30 by placing its hooks 51 through respective holes 35 of the top cover 30 to form a tank that can be shouldered or just carried by hands.

Figure 4:
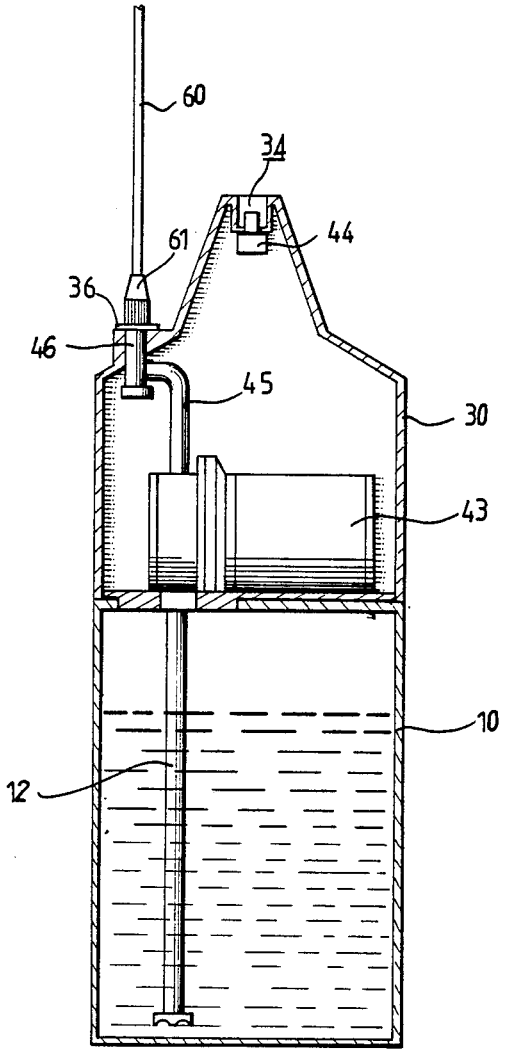
FIG. 4 is a sectional view of the garden sprayer taken along line 4—4 of FIG. 1.

With particular reference to FIGS. 1, 3 and 4, the manner the garden sprayer is used can be understood. When it is desired to operate the garden sprayer, the belt 50 can be first adjusted to a length suitable for operation or the container can just be carried by hand. The container 10 is filled with water or other liquid through the inlet 14. The nozzle tube 60 is taken away from the holder 392 and the switch 44 is turned on. By means of the power supplied by the closed-type battery 41, the pump 43 is turned on and pumps the liquid from the container 10 through the lower suction tube 16, the upper suction tube 45, the nozzle tube 60 and the spiral groove 664 to the nozzle head 67 and is sprayed out in mist form. Since the sprayer of the invention is actuated electrically, the spraying of liquid is continuous and requires no manual assistance to pump the liquid. When it is desired to spray taller plants, more middle tube 65 can be fitted to the nozzle tube 60 so as to increase the length of the nozzle tube 60. Also, the closed-type battery 41 is rechargeable via the socket 42.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as fall within the scope of the appended claims.

I claim:

1. A rechargeable garden sprayer comprising:

a container having an opening on an upper face thereof, a lower suction tube being insertable in said container through said opening, an inlet formed at a lateral side of said container, said inlet cooperating internally with said container such that liquid poured in through said inlet flows to said container;

an engaging body mounted on said container, said engaging body including a plurality of upstanding hollow tubes along a periphery of a base thereof, a fixing panel to define a retaining recess, and a border panel;

a top cover being substantially an inverted U-shaped body having two fixing edges, said top cover including two side panels, each inner side of said two side panels being provided with a plurality of downwardly extending holes; said plurality of hollow tubes receive and retain said downwardly extending poles therein so as to secure said top cover to said engaging body, said top cover having a handle on an uppermost part thereof, a charging hole being formed beneath said handle; a first end cover and a second end cover being slidably engageable with said top cover, said first end cover including a plate, said second end cover including a holder;

a power unit including a closed-type battery retained in said retaining recess, a pump, a socket which is retained within said engaging body and in alignment with respect to said charging holes for recharging purposes, and a switch for controlling said pump, an upper suction tube which communicates with said lower suction tube being formed on an upper part of said pump; and a telescopic nozzle tube including an engaging ring which engages with said upper suction tube, a gripping tube, a soft hose, an upper extension tube and, a nozzle head for spraying liquid, said nozzle tube being held by said holder of said second end cover.

2. A garden sprayer as claimed in claim 1, wherein said inlet is provided with a filter net.

3. A garden sprayer as claimed in claim 1, wherein a cap having a sealing pad is provided to close the inlet.

4. A garden sprayer as claimed in claim 1, wherein two lateral surfaces of the container are respectively provided with indicating means to indicate the liquid level in the container.

5. A garden sprayer as claimed in claim 1, wherein said container is provided with a knob and said engaging body is provided with a slot for receiving said knob such that said engaging body is combined with said container.

6. A garden sprayer as claimed in claim 1, wherein a number of said downwardly extending poles is equal to a number of said hollow tubes and a diameter of each pole is equal to an inner diameter of each hollow tube.

7. A garden sprayer as claimed in claim 1, wherein said gripping tube is hollow with one end part thereof provided with threading.

8. A garden sprayer as claimed in claim 1, wherein an end of the soft hose is fixed on said engaging ring at a part having threading and another end part is fixed on a middle tube by a coil.

9. A garden sprayer as claimed in claim 1, further including a middle tube, wherein said middle tube is hollow with one end part provided with threading and said middle tube having a slidable engaging round band encompassing said middle tube and said gripping tube also having one end part provided with threading, said slidable round band combining with the threading of the gripping tube such that the gripping tube and the middle tube are combinable.

10. A garden sprayer as claimed in claim 1 further including a middle tube having one end part threaded, wherein said upper extension tube is hollow and has an end part formed in a slanted manner and includes a slidable engaging round band which encompasses the upper extension tube and matches the threading of the middle tube such that the upper tube and the middle tube are combinable.

11. A garden sprayer as claimed in claim 10, wherein an end part of said upper extension tube is provided with threading.

12. A garden sprayer as claimed in claim 10, wherein two outlets and a spiral groove are provided on a tip of the upper extension tube such that the nozzle head is fixable thereon.

* * * * *